United States Patent [19]

Hays et al.

[11] Patent Number: 4,729,678

[45] Date of Patent: Mar. 8, 1988

[54] METHOD AND APPARATUS FOR PRODUCING CHARACTERS IN BOLD FORM

[75] Inventors: Douglas E. Hays; James F. Lederer, both of Lexington, Ky.

[73] Assignee: International Business Machines Corporation, Armonk, N.Y.

[21] Appl. No.: 32,797

[22] Filed: Mar. 31, 1987

[51] Int. Cl.[4] ..... B41J 19/58

[52] U.S. Cl. ..... 400/304; 400/83; 400/210

[58] Field of Search ..... 400/83, 210, 304; 364/519, 518

[56] References Cited

U.S. PATENT DOCUMENTS 4,323,315 4/1982 Demonte ..... 400/83 X

FOREIGN PATENT DOCUMENTS 76282 5/1983 Japan ..... 400/210
102779 6/1983 Japan ..... 400/304
2157865 10/1985 United Kingdom ..... 400/210

*Primary Examiner*—Paul T. Sewell
*Attorney, Agent, or Firm*—John J. McArdle, Jr.

[57] ABSTRACT

A method and apparatus for printing characters in bold form in a typing system. As disclosed, characters entered through an input device such as a keyboard are printed on paper, placed in a display and stored in memory substantially as they are entered. After a group of characters, such as a line of characters, have been entered and printed, those characters which are to be printed in bold form are identified from the information stored in the memory. The thus-identified characters are then printed a second time at a position slightly offset from that of the first printing of each of the characters.

6 Claims, 3 Drawing Figures

METHOD AND APPARATUS FOR PRODUCING CHARACTERS IN BOLD FORM

BACKGROUND OF THE INVENTION

This invention relates generally to typing systems and more particularly concerns printing characters in bold form in such systems.

One method of accomplishing the printing of characters in bold form in a typing system is to print a character, reposition the printhead or print element over the already-printed character, with the printhead shifted a small amount (such as 1/60 of an inch), and then to print the character a second time. This gives the typist the opportunity to emphasize certain words in a sequence of words by printing those emphasized words in bold form. Such a technique for producing text in bold form can be employed, for example, in an electronic typewriter or in a computer-based typing system operated under software control to drive a printer in a "key-to-print" mode.

In another type of system, a computer-based word processing system, text is arranged in a printable form on a display screen, and then sent to a printer for printing. In such systems, text designated as "bold" on the display screen (as selected during keying of the text by the operator), is printed in bold form when the page or pages of text from the word processor are printed. This bold printing is accomplished by printing a whole line of text twice in succession, with the second pass starting a small amount, such as 1/60 of an inch, offset from the first pass.

When a two-pass bold printing function is implemented in a typewriter system, or in a computer-based system operating software simulating a typewriter, it is important to the operator that the placement of text on paper be interactive. That is, it is important for the operator to see the keyed-in characters on paper in order to adequately determine if characters are properly placed on the paper. This is especially important when filling in forms.

Therefore, the approach taken in word processing systems, that of delaying the printing of bold text (typically with the text only visible on a display screen) and then printing an entire line in two passes, is not adequate for the needs of a typist.

As stated above, in present typewriter systems implementing the feature of printing in bold form, each character to be printed in bold form is printed twice as it is keyed. This approach, however, has the shortcoming that the printer quickly falls behind the typist, and the operator once again loses the ability to observe the results of the entry of keystrokes as they are entered.

It is the general objective of the present invention to provide printing in bold form, in typing systems such as have been described, which permits good interactivity for the operator.

SUMMARY OF THE INVENTION

In carrying out the invention, characters to be printed in bold form are printed by printing a group of characters, such as a line of characters, substantially as the characters are entered through an input device such as a keyboard. The entered characters, whether or not they are to be printed in bold form, are at this time printed in non-bold form. Substantially simultaneously with the printing of the characters, information related to the characters is stored in a memory and the characters are displayed on a display. After the group of characters is printed, a determination is made, based upon the information stored in memory, of which characters are to be printed in bold form. These characters, which are to be printed in bold form, are each then printed a second time at a position offset from that of the first printing of each of the characters.

Advantageously, employing this technique, the operator can observe the placement of characters on paper as the characters are entered, and the printing apparatus can keep pace with the operator. Further, in the preferred form, the operator can observe in the display which characters are presently designated to be printed in bold form.

Further objects and advantages of the invention, and the manner of their implementation, will become apparent upon reading the following detailed description and upon reference to the drawings, in which:

Figure 1:
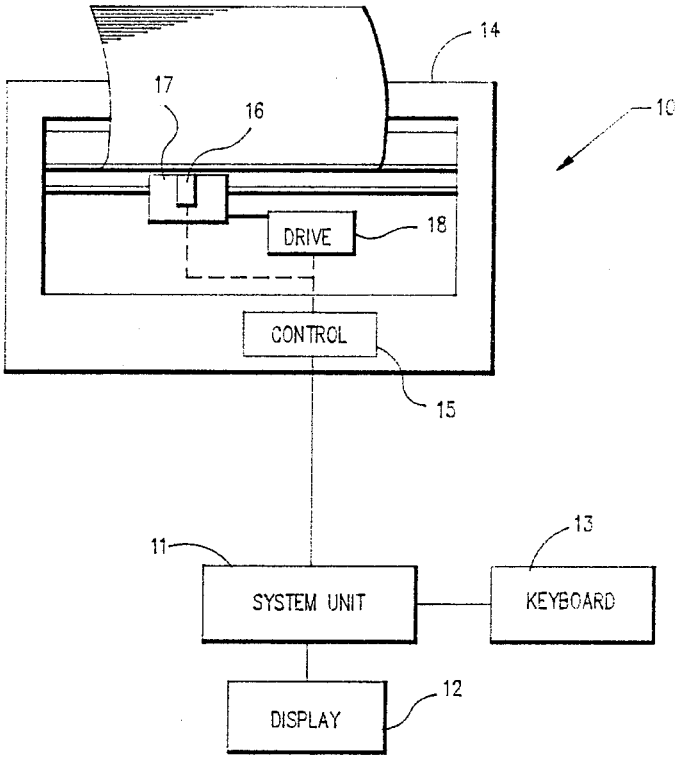
FIG. 1 is a diagrammatic illustration of a computer system including a printer with a printhead and a printhead drive.

While the invention is susceptible to various modifications and alternative forms, a specific embodiment thereof has been shown by way of example in the drawings and will herein be described in detail. It should be understood, however, that it is not intended to limit the invention to the particular form disclosed, but, on the contrary, the intention is to cover all modifications, equivalents and alternatives falling within the spirit and scope of the invention as defined by the appended claims.

The present invention is applicable to typing systems such as those in which a printing apparatus and control electronics which are contained in a single unit interface with an attached keyboard. Such a typing system usually includes control electronics comprising a microprocessor-based operating system for processing keystrokes entered through the keyboard and for other control functions. In the present instance, the invention shall be described in the form of a personal computer system executing application software to emulate an electronic typewriter, wherein a computer system unit interfaces with a display, a keyboard and a printer.

With reference now to FIG. 1, a personal computer system 10 includes a system unit 11, a display 12 and a keyboard 13. The keyboard 13 and the display 12 are coupled to the system unit 11 by conventional interfaces, and the system unit includes a disk drive for loading application software into the system unit memory. A printer 14 is also connected to the system unit 11, by a conventional printer parallel interface.

The printer 14 includes a printhead 16 mounted on a carrier 17 for translation laterally relative to paper upon which characters are to be printed. The printer 14 further includes a printhead drive 18 which moves the carrier 17. As diagrammatically shown in FIG. 1, printer commands are sent from the system unit 11 to a printer controller 15, which controls the printhead drive 18 and the printhead 16 in order to selectively print characters at selected positions across the paper. In practice, certain printhead and printhead drive control functions may be performed by hardware and software in the printer controller 15 or by the system unit 11 under software control. The allocation of these functions between the printer and the system unit is not critical to the practice of the present invention. The printer 14 also includes means (not shown) for advancing paper relative to the printhead 16.

In the illustrated system, the system unit 11 is operated by application software to emulate the operation of a typewriter. In order to do this, the "typewriter" application software is loaded into the system unit memory, accessible to the processor in the system unit. The processor processes keystrokes from the keyboard 13 and in turn supplies commands to the printer controller 15 to control the printhead drive 18 and the printhead 16 to print characters on paper substantially as the characters are entered through the keyboard.

When the typewriter application program is executed by the processor in the system unit 11, the processor performs appropriate initialization routines and then operates in a "key-to-print" mode to process keystrokes from the keyboard and to drive the printer 14. As keystrokes are received from the keyboard, the processor in the system unit 11 stores keystroke information in a memory location, designated a correction buffer, and in a display storage location, designated a video RAM. The information for up to one line of characters is supplied by the system unit from the video RAM to the display, and the characters are displayed in the display 12. At the same time, the keystroke information for up to a line of characters is stored in the correction buffer. When a line-ending keystroke, typically a carrier return (CR) keystroke, is received from the keyboard 13, the characters in storage are removed from the video RAM and from the correction buffer so that the storage of characters for the next line of text can begin.

Figure 2A:
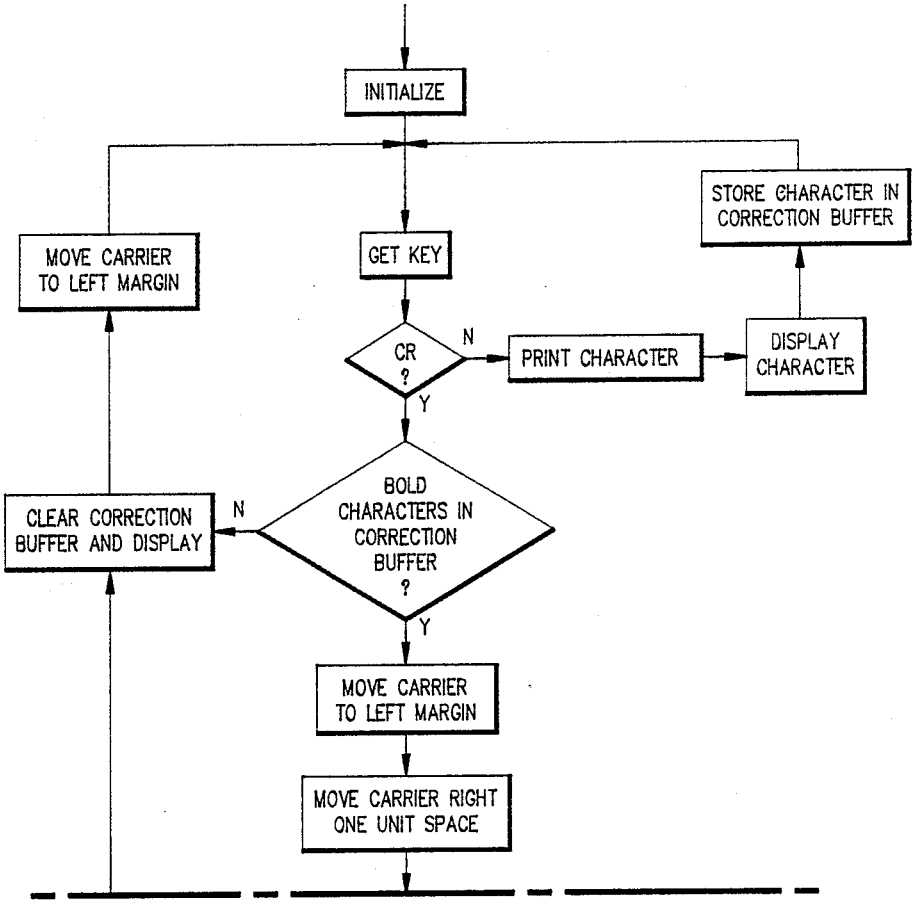
FIG. 2, which is shown as FIGS. 2A and 2B joined together at the dashed line, is a flowchart of a portion of a "typewriter" application program operated in the computer system to drive the printer of FIG. 1.
Figure 2B:
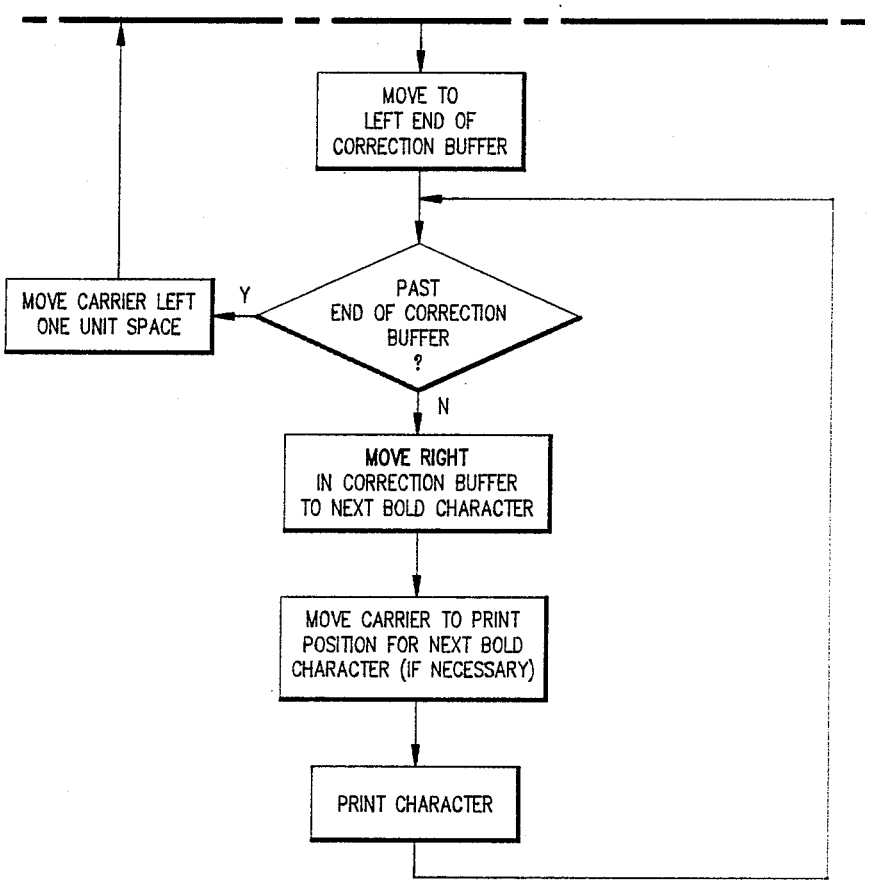

With reference to FIG. 2, as the processor in the system unit 11 obtains each keystroke from the keyboard 13, a check is performed to determine if the keystroke is a carrier return keystroke. If not, the processor sends suitable keystroke information to the printer 14 (typically, to print the character) and also sends appropriate keystroke information to the correction buffer and to the video RAM for the display.

For the purposes of description of the invention, typical keystrokes of alphanumeric characters shall be described. It should be understood that certain keystrokes result in keystroke information being coupled to less than all three of (a) the video RAM, (b) the correction buffer, and (c) the printer.

As thus far described, the system 10 operates to place characters on paper as they are entered at the keyboard 13. By a particular combination of keystrokes, the operator at the keyboard can invoke the bold form of printing of characters in the course of entering characters to be printed. The operator does this by entering designated "begin bold" and "end bold" keystroke sequences before and after a series of characters to be printed in bold form. A "bold" designation, or attribute, for characters entered between the "begin bold" and "end bold" keystroke sequences, is stored with each character to be printed in bold form when the character information is stored in the correction buffer. Advantageously, a "bold" indication for each character to be so-printed is also produced in the display for that character. For example, a special symbol or color is associated with each displayed character which is to be printed in bold form.

Returning to FIG. 2, when a carrier return keystroke is encountered, the processor checks the correction buffer to determine if there is a "bold" attribute associated with any of the characters therein. If not, the processor clears the correction buffer and the display and moves the printhead to the left margin. The processor then returns to process keystrokes for the next line of text.

If there are any characters bearing a "bold" attribute in the correction buffer, the carrier is moved to the left margin and then incremented to the right one unit space. In the present instance, one unit space to the right is a distance to the right of 1/60 of an inch.

The processor then moves to the left end of the correction buffer to begin scanning the buffer for the location of characters bearing a "bold" attribute. If the processor is not past the right end of the correction buffer (i.e. not yet finished scanning the correction buffer), the processor moves to the right through the correction buffer to the next character having a "bold" attribute. The processor also sends a command to the printer to move the printhead to the proper print position for this character. The character is then printed (for the second time, with a 1/60 of an inch offset from the first printing).

The processor then loops to determine if it is past the end of the correction buffer. If it is not, the processor again moves to the right in the correction buffer to the next "bold" character and directs the printer to move the printhead to the proper position and to print the carrier. The processor continues looping in this fashion until it reaches the end of the correction buffer. At that time, the carrier is moved one unit space back to the left, placing it in the correct position for printing the next line, the correction buffer and display are cleared, and the carrier is moved to the left margin.

What is claimed is:

1. A method of printing characters in bold form in which a character is printed a first and a second time, with the second printing of the character occurring at a position offset from that of the first printing of the character, comprising the steps of:

printing a group of characters, such as a line of characters, substantially as the characters in the group of characters are entered through an input device;

substantially simultaneously with said printing, storing information related to said characters in the group of characters in a memory and displaying said characters in a display;

after printing the group of characters, determining from the information stored in the memory which characters, if any, in the group of characters are to be printed in bold form; and printing each of said characters which are determined to be printed in bold form a second time at a position offset from that of the first printing of each of said characters.

2. The method of claim 1 in which the step of storing information related to said characters in the group of characters in a memory comprises storing information that includes a bold attribute for each character which is to be printed in bold form.

3. The method of claim 2 in which the step of storing information related to said characters in the group of characters in a memory comprises storing information in a correction buffer.

4. The method of claim 3 in which the step of printing a group of characters comprises printing a group of characters substantially as the characters in the group of characters are entered by an operator through a keyboard.

5. In a typing system having (a) a printer, including a printhead and a printhead drive for moving the printhead relative to a medium upon which characters are to be printed, (b) input means for entering characters to be printed, and (c) a display for displaying entered characters, the improvement comprising:

means for controlling the printhead and the printhead drive to print a group of characters, such as a line of characters, substantially as characters in the group of characters are entered through the input means;

means for displaying entered characters on the display substantially simultaneously with printing of the characters;

means for storing information related to entered characters, including information indicative of characters to be printed in bold form, substantially simultaneously with printing of the characters;

means for identifying, from said stored information related to entered characters, characters in the group of characters which are to be printed in bold form; and means for controlling the printhead and the printhead drive to print each of the identified characters a second time, at a position offset from that of the first printing of each of the identified characters.

6. The system of claim 5 in which the means for entering characters to be printed comprises a keyboard, and the means for storing information related to entered characters comprises a correction buffer.

* * * * *